US006988774B1

(12) United States Patent
Elzenbeck

(10) Patent No.: US 6,988,774 B1
(45) Date of Patent: Jan. 24, 2006

(54) BEDSTEAD

(75) Inventor: Manfred Elzenbeck, Steinheim (DE)

(73) Assignee: Roessle & Wanner GmbH, Moessingen (DE)

( * ) Notice: Subject to any disclaimer, the term of this patent is extended or adjusted under 35 U.S.C. 154(b) by 649 days.

(21) Appl. No.: 09/622,830

(22) PCT Filed: Feb. 16, 1999

(86) PCT No.: PCT/EP99/00991

§ 371 (c)(1),
(2), (4) Date: Oct. 18, 2000

(87) PCT Pub. No.: WO99/43239

PCT Pub. Date: Sep. 2, 1999

(30) Foreign Application Priority Data

Feb. 24, 1998 (DE) ..... 198 07 741

(51) Int. Cl.
*A47C 7/02* (2006.01)

(52) U.S. Cl. ..... 297/452.56; 5/187; 5/618

(58) Field of Classification Search ..... 297/452.56, 297/452.12, 452.13, 452.14, 452.55, 452.58, 297/452.59, 452.63; 5/111, 187, 618
See application file for complete search history.

(56) References Cited

U.S. PATENT DOCUMENTS

| | | | | | |
|---|---|---|---|---|---|
| 2,127,710 | A | * | 8/1938 | Baker | |
| 2,171,251 | A | * | 8/1939 | Capron | 5/618 X |
| 2,251,381 | A | | 8/1941 | Blair et al. | |
| 3,004,623 | A | * | 10/1961 | Nissen | 5/111 X |
| 3,373,453 | A | * | 3/1968 | Goodman | 5/618 X |
| 3,559,654 | A | * | 2/1971 | Pope, Jr. | 450/95 |
| 3,636,573 | A | * | 1/1972 | Bartz | 5/618 |
| 3,699,593 | A | * | 10/1972 | Oetiker | 5/111 |
| 3,910,075 | A | * | 10/1975 | Holliday | 66/192 |
| 3,987,504 | A | * | 10/1976 | Fox | 5/618 X |
| 4,469,738 | A | | 9/1984 | Himelreich | |
| 4,693,512 | A | * | 9/1987 | Hobson | |
| 4,837,878 | A | | 6/1989 | Huemer | |
| 4,842,335 | A | * | 6/1989 | Wunderlich | |
| 4,869,554 | A | * | 9/1989 | Abu-Isa et al. | 5/187 X |
| 4,894,877 | A | * | 1/1990 | Marsh | 5/618 |
| 5,301,377 | A | * | 4/1994 | Kim | 5/111 X |
| D394,356 | S | * | 5/1998 | Chen | D6/361 |

FOREIGN PATENT DOCUMENTS

| | | | |
|---|---|---|---|
| DE | 15233 | | 11/1880 |
| DE | 525224 | | 4/1931 |
| DE | BE 881639 | | 8/1980 |
| DE | 9191997 | | 5/1991 |
| EP | 107283 | | 2/1984 |
| GB | 2038382 | * | 7/1980 |
| GB | 1599635 | | 10/1981 |
| WO | WO 87/07125 | | 12/1987 |

* cited by examiner

*Primary Examiner*—Rodney B. White
*Assistant Examiner*—Stephen Vu
(74) *Attorney, Agent, or Firm*—Crowell & Moring LLP

(57) ABSTRACT

A lounge chair with a frame having longitudinal and transverse bars and with spring elements held by the frame. The spring elements being in the form of an elastic textile structure held under prestress between the longitudinal bars and forming a supporting surface covering the frame. The textile structure is made out of synthetic threads. A first prestress of the textile structure at a right angle to the longitudinal bars in a first section is different from a second prestress of the textile structure at a right angle to the longitudinal bars in a second section.

21 Claims, 3 Drawing Sheets

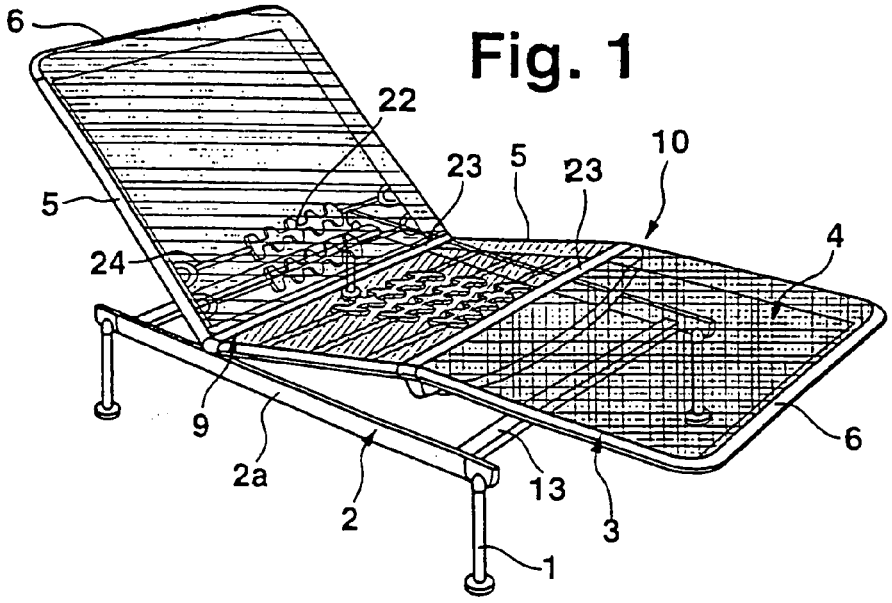
Fig. 1
Fig. 2
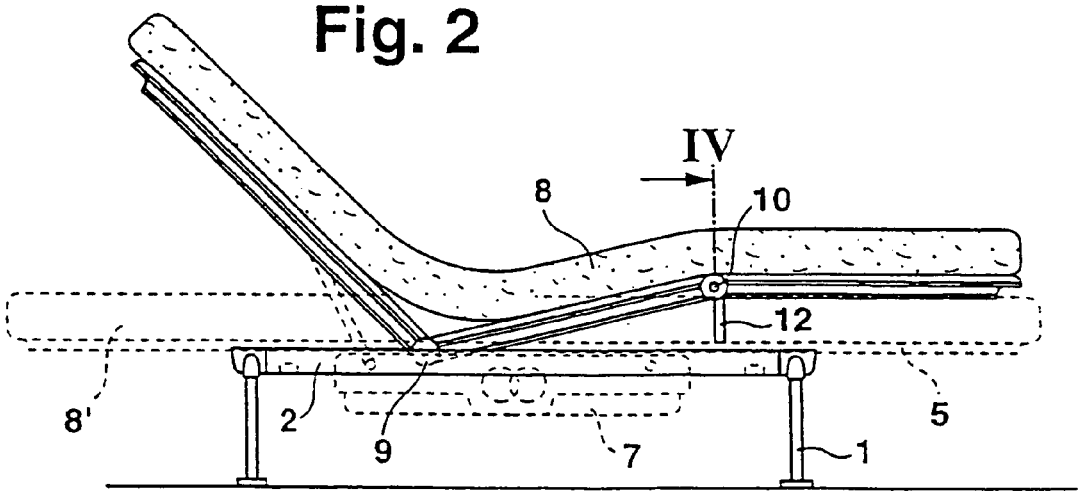
Fig. 3
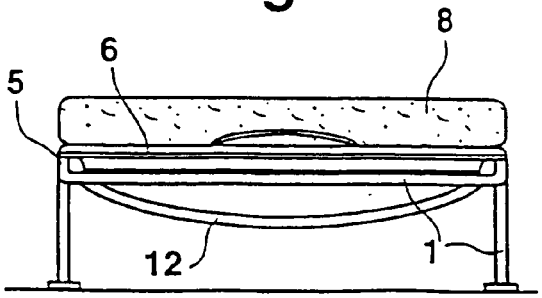
Fig. 4
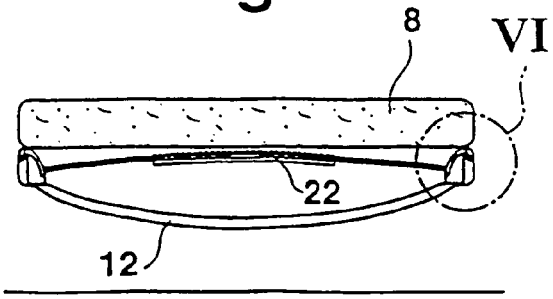

BEDSTEAD

This application claims the priority of German Application No. 198 07 741.6, filed Feb. 24, 1998, and PCT Application No. PCT/EP99/00991, filed Feb. 16, 1999.

BACKGROUND AND SUMMARY OF THE INVENTION

The invention relates to a lounge chair with a frame and spring elements held by the frame, said spring elements forming the supporting surface, covering the frame, for mattresses or the like.

In EP 0 734 666 A1, the supporting surface for a cushion of such a lounge chair is known, the supporting surface holding a flat underlay in a frame, on which spring elements are set on the underlay with their bases in a regular grid. The spring elements have heads that form the supporting disks for a continuous cushion or the like. Such supporting surfaces that are also supposed to be used for beds can be provided with a lath grid (DE 29 707 790 U1) instead of the much more commonly used lounge chairs, with said supporting surfaces having spring laths as underlay for a mattress or the like, running at right angles to the longitudinal bars of a frame.

For folding chaise lounges or deckchairs, stretching a textile covering between the longitudinal and transverse bars of a foldable chaise lounge frame, such that the edges of the textile structure are placed around the longitudinal and transverse bars and fastened there, is also generally known (DE-GM 7531803). As a result, grooves must be provided on the hinges in order not to interfere with the hinge function. Such chaise lounges cannot be used as base frames for beds.

The same also applies to deckchairs that can be transformed into folding lounge chairs (CH-PS 390 901), where the textile covering is pulled over the folding frame with the help of pockets placed at the head and foot end, thereby achieving the fastening of the textile structure. Providing widenings with reinforcement inserts in the joints, which help to conceal the joints, is also known. However, such chaise lounge furniture cannot be used as replacement for a bedstead. The same also applies to a lounge chair intended as garden or camping furniture (AT-PS 312 844), which is constructed from a folding frame, which serves as a holding device for elastic straps that turn into a textile structure towards the center of the chaise lounge furniture. This design is meant for the chaise lounge to also serve as a kind of trampoline for children.

And finally, chairs or deckchairs are also known (DE 44 26 316 C1 ), in which the seat or back surface comprises a textile cover formed into a loop at its edges, and with these, is slid on rod-like spanners, which are in turn screwed down to the longitudinal bars of the chair frame. This embodiment makes it possible to remove the cover from the frame for purposes of cleaning.

The task of the present invention is to design a lounge chair of the type mentioned at the start, which can also serve as a bed frame, with the design to be made in a much simpler manner, such that spring bearing pressure can be provided over the entire lying surface without having to provide in a costly manner spring elements, distributed on the surface, on a fixed underlay or laths running at right angles to the longitudinal bars of the frame.

To solve this task, in a lounge chair of the type mentioned at the start, the invention suggests that the spring elements be made of a textile structure made of elastic threads, said textile structure being in the form of a knitting or woven fabric made of synthetic threads and being held under prestress at least at the longitudinal bars of the frame.

This embodiment creates a supporting surface for the cushion underlay of a bed or the like, which, depending on the prestress of the textile structure, can introduce spring restoring forces that is influenceable to the desired extent. The design of such a supporting frame remains extremely simple.

In a further embodiment of the invention, the prestress of the textile structure at right angles to the longitudinal bars can be different from that in other sections in at least one of several sections running lengthways of the longitudinal bars, making it possible, just like in lath grids or in individually adjusted spring elements, to exercise varying, zone-by-zone return forces to a chaise lounge cushion, and consequently, to a person lying on the cushion. For modern types of bed underlays, this is an important measure that promotes lying comfort, and consequently, healthy sleep. The outer edges of the textile structure can be held in a very simple manner at the longitudinal and transverse bars, in which the frame can also be provided with foldable longitudinal bars that facilitate an adjustment of the lying surface.

In a particularly advantageous further embodiment of the invention, the knitting or woven fabric of the textile structure can consist of polyester threads, preferably with about 25% elastomer polyester content.

The textile structure can also advantageously consist of two textile structures arranged at a distance one below the other, which, in the presence of a load, rest on top of each other, thereby allowing high return forces to be realized.

The invention also relates to a method for the manufacture of a lounge chair of the type mentioned in the beginning. In this method, a cut of the textile structure formed by the threads, to be put into the frame, is first made, its crosswise measurements being less than the distance of the longitudinal bars and its outer contour, at least at one spot of one of the side walls is not straight and parallel to the longitudinal bars. The cut formed in such a manner is, while expanded, fastened at least in crosswise direction to the longitudinal bars with its longitudinal outer contours. Since the outer contour of the cut does not run parallel to the longitudinal bars, but the outer edges are drawn up to the longitudinal bars before they are fastened there, a varying prestress of the woven fabric arises in different zones of the supporting surface designed in such a manner, as a result of which the return forces exercised by the supporting surface can be divided among different zones, at least lengthways of the longitudinal bars. In this manner, it is possible to adjust the degree of the elasticity, which reacts to a load, to the spring properties of known lath grids or the like, in which varying bearing pressure can likewise be exercised on a bed cushion, and consequently, on a person lying thereon.

Of course, it is also possible to correspondingly change the prestress of the elastic woven or knotted structure in zones that are lengthways of the transverse bars, so that in this manner, in a relatively simple way, and without having to distribute individual spring elements on a supporting surface, zones of greater and lesser return forces can be realized for the supporting surface.

BRIEF DESCRIPTION OF THE DRAWINGS

The invention is presented with the help of an embodiment in the drawing and will be explained in the following.

To illustrate:

FIG. 1 is a perspective representation of a lounge chair according to the invention, with sections of the lying surface adjusted differently.

FIG. 2 is a side view of the lounge chair of FIG. 1, but with a cushion support and with a representation of the sections of the lying surface folded down to a common horizontal plane.

FIG. 3 is a front view of the lounge chair of FIG. 2 with sections of the lying surface found in the folded down position.

FIG. 4 is a section through the lounge bed of FIG. 2 along Line IV.

DETAILED DESCRIPTION OF THE DRAWINGS

Figure 5:
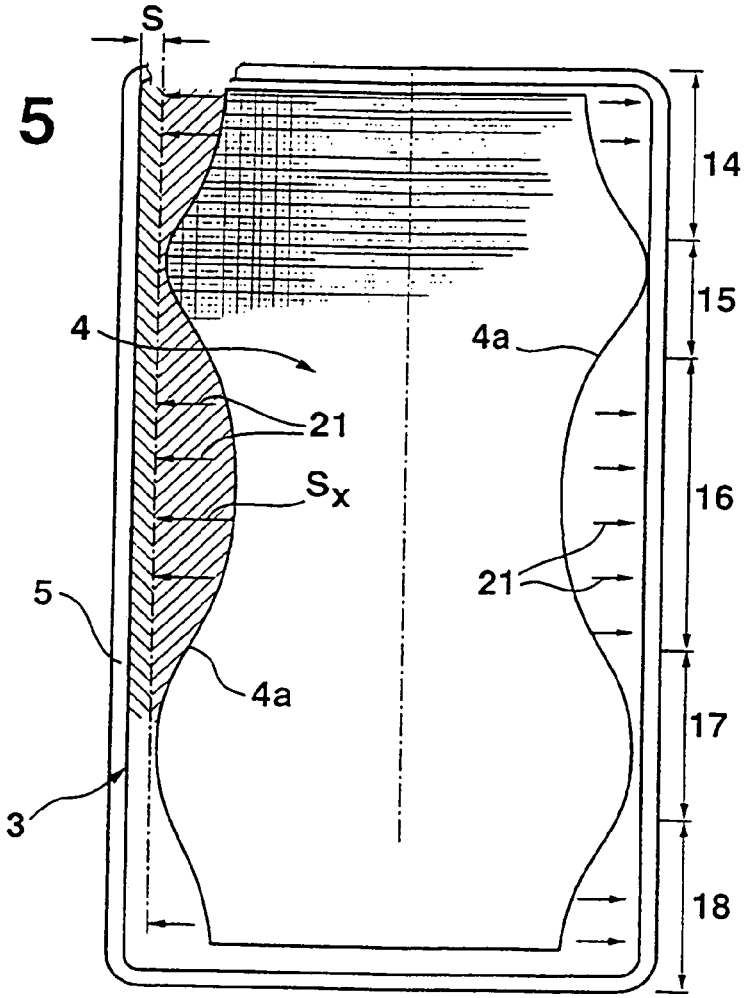
FIG. 5 is a schematic representation of a weave section, which is subsequently held tightly in the lounge bed frame.

A lounge chair is shown in FIGS. 1 and 2, consisting of a base frame 2 provided with supports 1, said base frame with longitudinal bars 2*a* and transverse bar 13 and a frame 3 forming a surface for lying, which in the embodiment is covered with an elastic knitting 4. The frame 3 consists of two longitudinal bars 5 constructed in a foldable manner, which are held at a distance by transverse bars 6. The longitudinal bars 5 constructed in a foldable manner makes it possible in a known manner to divide the surface of the bed for lying into several sections, which can be inclined to one another under certain angles, as presented in FIGS. 1 and 2. However, the longitudinal bars 5 can also be placed in a stretched position so that the bed exhibits a level surface for lying, as shown by the broken lines in FIG. 2. The adjustment of the longitudinal bars in the embodiment likewise follows in a known manner through an electric drive 7, shown with broken lines in FIG. 2. In FIG. 2, the surface of the bed for lying is provided with an elastic cushion support 8, whose extended position is shown with 8' in FIG. 2.

The knitting 4 held tightly in the frame 3 consists of elastic synthetic threads, for which purpose a knitting made of polyester threads with approximately 25% elastomer polyester content is used. This known knitting, sold under the brand name "Gemstone Crystal Flex II" by Milliken Europe N.V. in Gent, Belgium, is an elastic weaving that can be stretched bidirectionally and that, according to the invention, is inserted in prestressed condition into the bearing frame 3 at least crossways between the two longitudinal bars 5. The process involved will be discussed in detail using FIGS. 5 and 6.

FIGS. 3 and 4 show for the present, however, that the longitudinal bars 5, aside from being provided with the two transverse bars 6 placed at their ends, are also provided with additional transverse braces, each in the area of their two joint axles 9 and 10. Thus, in the area of the joint axle 9 that, like the joint axle 10 is not made of a continuous wave or the like, but is made with joint arrangements only in the area of the longitudinal bars, a coupling is provided on the base frame 2, while an additional transverse reinforcing clip 12 is provided in the area of the articulated axle 10. This forms a stable, supporting frame 3, which can hold under a predetermined tensile stress, the elastic knitting 4 inserted.

This elastic knitting is put into the frame 3 in such a way that it is inserted in crosswise direction between the two longitudinal bars 5 with zones 14, 15, 16, 17 and 18 of varying prestress.

This is attained by providing the elastic knitting 4, as schematically presented in FIG. 5, before insertion into the frame 3, which is rectangular, with a cut contour deviating from the rectangular form, whose outer contours 4*a* run curved and, as shown in FIG. 5, is made wider in zones 15 and zone 17 than in the zones 14, 16 and 18. If, according to the invention, the outer contours 4*a* of this elastic knitting 4, are pulled outwards following the arrow 21 up to the longitudinal bars 5, a prestress greater than in the zones in between is created because of the greater extension between the longitudinal bars 5 in the zones 14, However, FIG. 5 also makes it clear that even in Zones 15 or 17, the knitting 4 is still subjected to a prestress because it must be stretched outwards here, at least by the s amount, up to the particular longitudinal bars before it is mounted to the longitudinal bars. In zones 15 and 17, therefore, there would be return forces in the embodiment shown, depending on the stretching of the knitting 4 by the amount s, but in zones 16, 14 and 18, there would be return forces caused by the expansion of the knitting by the amount s plus $s_x$.

Figure 6:
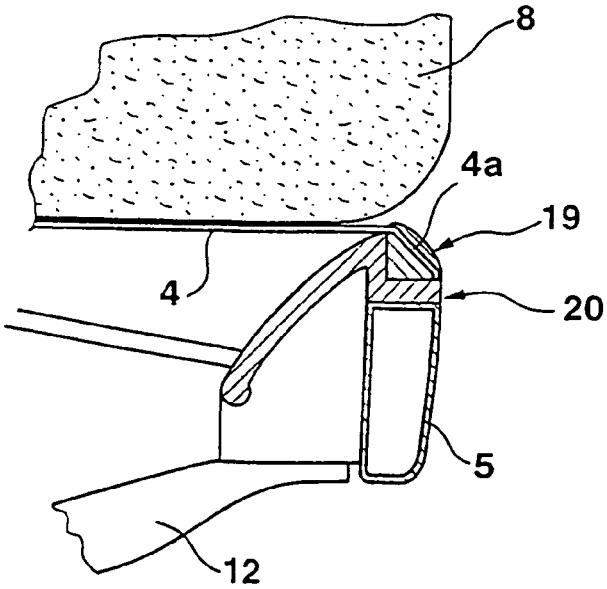
FIG. 6 is an enlarged partial representation of the detail VI of FIG. 4.

FIG. 6 shows that the cut of the knitting 4 (FIG. 5), which is initially not rectangular, after it is made rectangular through the corresponding expansion, is fit and held into clamping strips 19 with the outer edges 4*a*, said clamping strips in turn set in receptacle strips 20, which are fastened to the longitudinal bars. The knitting 4 variedly stretched in this manner in different zones is then held at the frame 3 and can, as explained, form a surface for lying, which presents varying softness for a load.

FIGS. 1 and 4 also makes it clear that in addition to the tension of the knitting, supports can also be provided beneath the same, and may consist of rails 24 with supports 22 arranged on them, and movable lengthways of the longitudinal bars 5, and which additionally support in certain locations the rest for the cushion and for a person. It would also be possible to place supports on the knitting 4, which are intended, for instance, as lordosis support in the lumbar region or as knee joint supports in the support region of the legs of a person using the bed. These additional supports may, for instance, be fastened to a suitable location with a Velcro on the knitting 4.

Figure 7:
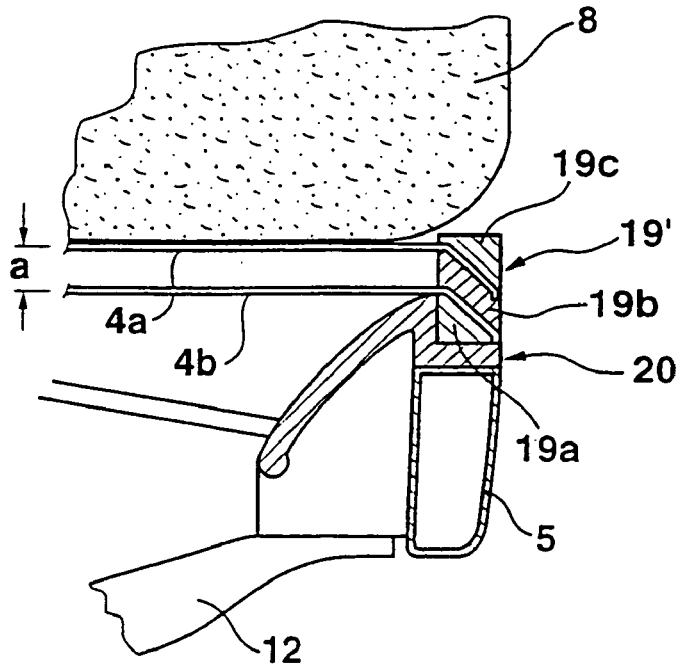
FIG. 7 is a partial representation similar to FIG. 6, but in another form of embodiment.

FIG. 7 shows a modified embodiment of holding the textile structure tight to the side longitudinal bars 5. A clamping strip 19', comprising the three strip sections 19*a*, 19*b* and 19*c*, is provided for holding the edge of the textile structure tight. Between each of these strips, the margin of a textile structure 4*a* and the margin of a textile structure 4*b* is held tightly, in which the textile structure 4*a* and 4*b*, made of elastic threads, run parallel to one another at a distance a, which may amount to between 3 and 5 cm in practice. The lower textile structure 4*b* is generally a little more tightly stretched than the upper structure 4*a*, and as was previously explained in detail in FIG. 5, there may also naturally be a different tension here over the length of the longitudinal bars 5. When there is pressure on the mattress 8, the upper textile structure 4*a* sags, and if this sagging is greater than the distance a, the upper textile structure 4*a* rests on the lower 4*b*. Due to this measure, an essentially higher retention force and return force is provided from this point onwards. The embodiment according to FIG. 7 therefore allows an adjustment of the elasticity over a wide load range so that as a result, persons with low body weight, as well as those with greater body weight, can lie comfortably on the bed frame designed in such a manner.

Figure 8:
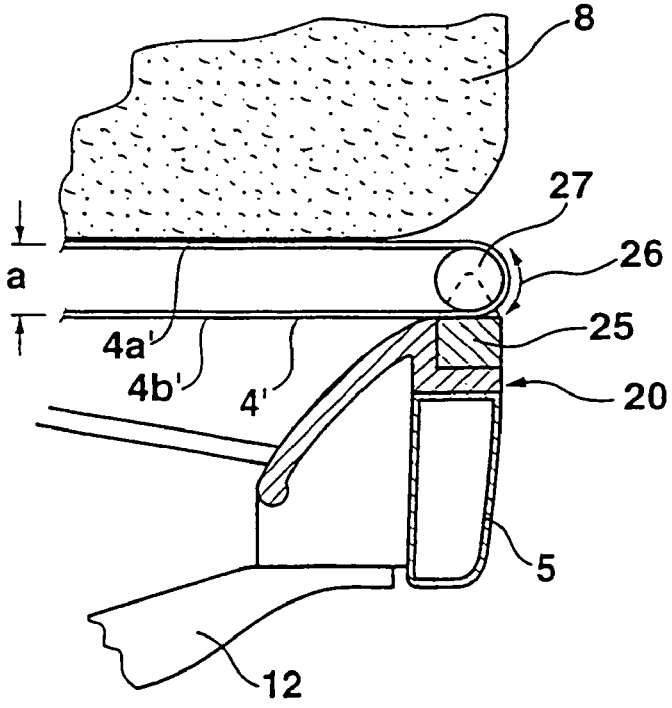
FIG. 8 is a partial representation similar to FIG. 6, but in another form of embodiment.

FIG. 8 shows a variation of the embodiment with two textile structures 4*a*' and 4*b*' arranged one below the other. In the embodiment of FIG. 8, these two structures are part of a tube 4', which is pushed through lateral rods 27, which on their part are, in a manner not further illustrated, mounted rigidly, or as defined by the arrow 26, mounted so that they can be rotated on rails 25, which are solidly connected to the longitudinal bars 5 or with the receptacle strips 20 of the same. In this embodiment, through the load of the upper strand of the tube 4' formed by the structure 4*a*', the lower strand, i.e., the textile structure 4*b*', is additionally stretched so that even in this case, additional forces can be absorbed if the upper and lower strand of the tube 4' come into contact with each other.

It has previously only been explained that and in what type and manner the elastic knitting 4 is prestressed crosswise between the longitudinal bars 5. Of course, it is also possible to provide a varying tension in the direction of the longitudinal bars between the transverse bars 6, if desired.

However, problems in the joint axles 9, 10 may arise, where, as FIG. 1 shows, cover strips 23 running crosswise are placed on the knitting 4, said cover strips protecting the folding edge of the knitting 4.

What is claimed is:

1. A lounge chair with a frame having longitudinal and transverse bars and with spring elements held by the frame, said spring elements being in the form of an elastic textile structure held under a pre-strained condition between the longitudinal bars to change the size of said textile structure to provide an associated prestress of the textile structure and forming a supporting surface covering the frame wherein the textile structure is made out of synthetic threads, and wherein a first prestress of the textile structure at a right angle to the longitudinal bars in a first section is substantially different from a second prestress of the textile structure at a right angle to the longitudinal bars in a second section.

2. The lounge chair according to claim 1, wherein outer contours of the textile structure are held under prestress at the longitudinal bars and at the transverse bars.

3. The lounge chair according to claim 2, wherein cushions can be placed on the textile structure.

4. The lounge chair according to claim 2, wherein the longitudinal bars are designed to be foldable and form articulated axles for the surface for lying.

5. The lounge chair according to claim 1, wherein supports are provided beneath the textile structure.

6. The lounge chair according to claim 5, wherein the supports are attached to rails which are movable in a direction of the longitudinal bars.

7. The lounge chair according to claim 6, wherein cushions can be placed on the textile structure.

8. The lounge chair according to claim 6, wherein the longitudinal bars are designed to be foldable and form articulated axles for the surface for lying.

9. The lounge chair according to claim 5, wherein cushions can be placed on the textile structure.

10. The lounge chair according to claim 5, wherein the longitudinal bars are designed to be foldable and form articulated axles for the surface for lying.

11. The lounge chair according to claim 1, wherein cushions can be placed on the textile structure.

12. The lounge chair according to claim 11, wherein the longitudinal bars are designed to be foldable and form articulated axles for the surface for lying.

13. The lounge chair according to claim 11, wherein the cushions are in the form of lordosis supports.

14. The lounge chair according to claim 11, wherein the cushions are in the form of knee joint supports.

15. The lounge chair according to claim 1, wherein the longitudinal bars are designed to be foldable and form articulated axles for the surface for lying.

16. The lounge chair according to claim 1, wherein the synthetic threads are polyester threads with a 25% elastomer polyester content.

17. The lounge chair according to claim 1, wherein the textile structure is made up of two structures wherein one of the two structures lies at a distance below the other of the two structures.

18. The lounge chair according to claim 17, wherein each of the textile structures is tightly held by a respective edge to the longitudinal and transverse bars.

19. The lounge chair according to claim 17, wherein the distance between the two textile structures is predetermined in such a way that at least a part of a surface of one of the two structures rests on at least a part of a surface of the other of the two structures when there is a load.

20. The lounge chair according to claim 17, wherein the textile structure is designed as a tube pulled over rods.

21. The lounge chair according to claim 20, wherein the rods are mounted such that they can be rotated and are fastened to the longitudinal bars.

* * * * *